US008936855B2

(12) United States Patent
Kimuro et al.

(10) Patent No.: US 8,936,855 B2
(45) Date of Patent: Jan. 20, 2015

(54) WOOD FIBER BOARD AND MANUFACTURING METHOD THEREOF

(75) Inventors: Makoto Kimuro, Nagoya (JP); Hiromasa Sinkai, Chita (JP); Kenji Takeshita, Tokai (JP)

(73) Assignee: Nichiha Corporation, Nagoya-Shi (JP)

( * ) Notice: Subject to any disclaimer, the term of this patent is extended or adjusted under 35 U.S.C. 154(b) by 393 days.

(21) Appl. No.: 13/272,335

(22) Filed: Oct. 13, 2011

(65) Prior Publication Data

US 2012/0108706 A1 May 3, 2012

(30) Foreign Application Priority Data

Oct. 29, 2010 (JP) ..... 2010-244404

(51) Int. Cl.
*B32B 23/04* (2006.01)

(52) U.S. Cl.
USPC ..... 428/536; 428/292.4; 427/212; 427/393; 162/123

(58) Field of Classification Search
USPC ..... 428/292.4, 536; 427/212, 393; 162/123
See application file for complete search history.

(56) References Cited

U.S. PATENT DOCUMENTS

| | | | | |
|---|---|---|---|---|
| 6,379,497 | B1 * | 4/2002 | Sandstrom et al. | 162/123 |
| 6,919,111 | B2 * | 7/2005 | Swoboda et al. | 428/34.2 |
| 2010/0125121 | A1 | 5/2010 | Nishio et al. | |

FOREIGN PATENT DOCUMENTS

| | | | |
|---|---|---|---|
| JP | 2001-003300 | * | 1/2001 |
| JP | 2001-3300 | A | 1/2001 |
| JP | 2010-121058 | A | 6/2010 |

* cited by examiner

*Primary Examiner* — Leszek Kiliman
(74) *Attorney, Agent, or Firm* — Birch, Stewart, Kolasch & Birch, LLP

(57) ABSTRACT

Provided is a wood fiber board, and a production method thereof, such that the wood fiber board contains no phenolic resin, is simple to produce, and exhibits flexural strength and water resistance comparable to those of wood fiber boards produced by incorporating a phenolic resin. The wood fiber board of the present invention has only wood fibers; a polyacrylamide resin being an amphoteric-ionic resin, which has monomers having cationic groups and monomers having anionic groups at a ratio of 7:3 to 3:7 on a mole ratio basis, and which has a molecular weight ranging from 800,000 to 3,000,000; and cationic paraffin. A method of producing a wood fiber board of the present invention involves preparing a slurry to a solids concentration ranging from 2 to 3 wt % and pH of 3 to 5, and adding only the polyacrylamide resin and paraffin to the slurry.

4 Claims, No Drawings

WOOD FIBER BOARD AND MANUFACTURING METHOD THEREOF

BACKGROUND OF THE INVENTION

1. Field of the Invention

The present invention relates to a wood fiber board that is used in vehicle interiors, building materials, furniture and the like.

2. Description of the Related Art

Conventionally, wood is made into wood chips using a crusher or the like, the obtained wood chips are steamed and are fibrillated using a refiner or the like, to produce a fiber board out of the wood fibers. For instance, Japanese Patent Application Publication No. 2001-3300 discloses a method of manufacturing a wood fiber board by forming a sheet out of a starting material slurry in which wood fibers are dispersed, dewatering the formed sheet by suction, using a cylinder sheet-forming machine, followed by forming and drying, to produce thereby a wood fiber board.

The production method set forth in Japanese Patent Application Publication No. 2001-3300 requires a binder for binding fibers to each other. Japanese Patent Application Publication No. 2001-3300 discloses, starch thickeners, phenolic resins, melamine resins, urea resins and the like as examples of binders. Among those, phenolic resins have been used from the viewpoint of strength and water resistance.

However, concerns about the odor and volatile organic compounds released by phenolic resins have become a concern against the background of growing environmental awareness in recent years. Desirably, therefore, wood fiber boards should contain no phenolic resins.

The applicants had already filed Japanese Patent Application Publication No. 2010-121058 relating to a phenolic resin-free wood fiber board.

The wood fiber board of Japanese Patent Application Publication No. 2010-121058 is produced using an acrylic resin and an epoxy resin containing no bisphenol A, instead of using a phenolic resin. Therefore, the board has no phenol odor, and the release of volatile organic compounds is extremely small.

The wood fiber board of Japanese Patent Application Publication No. 2010-121058, however, utilizes two types of resin, namely an acrylic resin and an epoxy resin containing no bisphenol A, as binders, and requires moreover paraffin in order to enhance water resistance. The board is thus troublesome in terms of equipment and operations, which should be streamlined.

SUMMARY OF THE INVENTION

Therefore, it is an object of the present invention to provide a wood fiber board, and a production method thereof, such that the wood fiber board contains no phenolic resin, is simple to produce, and boasts flexural strength and water resistance comparable to those of wood fiber boards produced by incorporating a phenolic resin.

The present invention provides a wood fiber board that comprises only wood fibers, a polyacrylamide resin and paraffin. In the wood fiber board of the present invention, the polyacrylamide is an amphoteric-ionic resin, contains monomers having cationic groups and monomers having anionic groups at a ratio of 7:3 to 3:7, on a mole ratio basis, and has a molecular weight ranging from 800,000 to 3,000,000; and the paraffin is cationic. The polyacrylamide resin content ranges from 0.1 to 0.6 wt % with respect to total solids of the wood fibers; and the paraffin content ranges from 0.2 to 0.9 wt % with respect to total solids of the wood fibers. The wood fibers are tangled with one another, and the polyacrylamide resin and the paraffin fill gaps between the wood fibers.

The wood fiber board of the present invention may contain fibers obtained through steaming and fibrillating of scrap wood from wood fiber boards, in an amount smaller than 10 wt % with respect to total solids of the wood fiber board. Effective utilization of scrap wood can be promoted thus by incorporating fibers obtained out of scrap wood from scrap wood fiber boards.

The present invention provides a method of producing a wood fiber board. The method of producing a wood fiber board of the present invention has the steps of: producing a slurry by dispersing wood fibers in water; producing a mat by adding only paraffin and an acrylamide resin to the obtained slurry and performing sheet forming; and heat-pressing the obtained mat, and wetting or humidity-conditioning the mat, followed by curing. In the step of producing a slurry, the slurry is prepared to a solids concentration of 2 to 3 wt % and pH of 3 to 5. In the step of producing a mat, an amphoteric polyacrylamide resin being an amphoteric-ionic resin, which contains monomers having cationic groups and monomers having anionic groups at a ratio of 7:3 to 3:7 on a mole ratio basis, and which has a molecular weight ranging from 800,000 to 3,000,000, is added 0.1 to 0.6 wt % with respect to total solids of the wood fibers, and cationic paraffin is added 0.2 to 0.9 wt % with respect to total solids of the wood fibers. In the method of producing a wood fiber board of the present invention, there may be incorporated fibers obtained through steaming and fibrillating of scrap wood from scrap wood fiber boards, in an amount less than 10 wt % with respect to total solids of the wood fiber board.

The wood fiber board of the present invention comprises only wood fibers, a polyacrylamide resin and paraffin, and hence comprises no phenolic resin. Also, the wood fibers are tangled with one another, and the polyacrylamide resin and the paraffin fill gaps between the wood fibers. Therefore, the wood fiber board boasts flexural strength and water resistance comparable to those of wood fiber boards produced by incorporating a phenolic resin. In the method of producing a wood fiber board of the present invention, a polyacrylamide resin alone is used as binder. Therefore, the wood fiber board is simple to produce and boasts flexural strength and water resistance comparable to those of wood fiber boards produced by incorporating a phenolic resin.

DESCRIPTION OF THE PREFERRED EMBODIMENTS

Specific embodiments of the present invention are explained below.

The wood fiber board of the present invention comprises only wood fibers, a polyacrylamide resin and paraffin.

The wood fibers of the present invention are obtained by chipping wood into wood chips using a crusher or the like, steaming the obtained wood chips, and fibrillating the steamed chips using a refiner pulper. The wood fibers may also contain wood fibers in the form of fibers obtained through steaming and fibrillating of scrap wood from scrap wood fiber boards.

The polyacrylamide resin is amphoteric, contains monomers having cationic groups and monomers having anionic groups at a ratio ranging from 7:3 to 3:7, on a mole ratio basis, and has a molecular weight ranging from 800,000 to 3,000,000. Examples of monomers having cationic groups include, for instance, a 2-(meth)acryloyloxyethyltrimethyl ammonium salt or 2-(meth)acryloylaminoethyltrimethyl ammonium salt, a diallyldimethyl ammonium salt, a diallylamine compound or the like. Examples of monomers having anionic groups include, for instance, α,β-unsaturated carboxylic acids and salts thereof. In the amphoteric polyacrylamide resin, the ratio of the monomers having cationic groups and monomers having anionic groups is set to range from 7:3 to 3:7, on a mole ratio basis. The wood fiber and the paraffin can be complemented as a result in the production process. In the production process of the wood fiber board, specifically, the wood fibers are firstly dispersed in water, to yield a slurry having a pH from 3 to 5, and paraffin and an acrylamide resin are then added to the slurry. Herein, the surface potential of the wood fiber is anionic, while the below-described paraffin is cationic. Thus, the amphoteric polyacrylamide resin can complement both the wood fibers and the paraffin. Also, flocks can be formed in the water having a pH ranging from 3 to 5 in which wood fibers are dispersed, by setting the content ratio of the monomers having cationic groups and the monomers having anionic groups to range from 7:3 to 3:7, on a mole ratio basis. Therefore, the wood fibers can be dewatered with good efficiency, and a mat of the wood fiber board can be produced with good yield. Further, paraffin can be complemented with good efficiency. The water resistance of the wood fiber board is enhanced thereby. Also, the molecular weight of the polyacrylamide resin ranges from 800,000 to 3,000,000, which results in a constant viscosity in the liquid state. The wood fibers and the paraffin can be easily complemented thereby. If the molecular weight of the polyacrylamide resin is smaller than 800,000, the flocks that form upon complementation of the wood fibers and the paraffin are small, and yield is poor. If the molecular weight exceeds 3,000,000, formation of strong flocks gives rise to uneven distribution of wood fibers, polyacrylamide resin and paraffin inside the wood fiber board obtained after dewatering. This may impair the flexural strength of the wood fiber board.

Paraffin is cationic. Accordingly, paraffin can be easily complemented by the amphoteric polyacrylamide resin. Also, the surface potential of wood fibers is anionic, and hence paraffin becomes readily fixed to the surface of the wood fiber.

The wood fiber board of the present invention contains 90 wt % or more, with respect to total solids of the wood fiber board, of fibers obtained through steaming and fibrillating of wood, contains 0.1 to 0.6 wt % of polyacrylamide resin with respect to total solids of the wood fibers, and contains 0.2 to 0.9 wt % of paraffin with respect to total solids of the wood fibers. The content of fibers obtained through steaming and fibrillating of scrap wood from scrap wood fiber boards can be smaller than 10 wt % with respect to total solids of the wood fiber board. As the scrap wood of the scrap wood fiber board there are preferably used parts of wood fiber board, defective boards and the like that occur in a production process, since this way the wastage of the production process can be reduced.

The rationale for setting the content of polyacrylamide resin to range from 0.1 to 0.6 wt % with respect to total solids of the wood fibers is that a content smaller than 0.1 wt % results in insufficient complementing of the wood fibers and the paraffin, whereas a content of polyacrylamide resin in excess of 0.6 wt % elicits no further effect for a higher cost. The reason for setting the content of paraffin to be no greater than 0.2 to 0.9 wt % with respect to total solids of the wood fibers is that the water resistance of the wood fiber board is poor if the content of paraffin is smaller than 0.2 wt %, while if the content exceeds 0.9 wt %, tangling among wood fibers becomes deficient, and the flexural strength of the wood fiber board is impaired.

The method of producing a wood fiber board of the present invention comprises the steps of: producing a slurry by dispersing wood fibers in water; producing a mat by adding only paraffin and an acrylamide resin to the obtained slurry and performing sheet forming; and heat-pressing the obtained mat, and wetting or humidity-conditioning the mat, followed by curing.

In the step of producing a slurry by dispersing wood fibers in water, wood is crushed, and is steamed and fibrillated in a fibrillating machine such as a refiner, and the wood fibers obtained as a result are dispersed in water, to yield a slurry having a solids concentration ranging from 2 to 3 wt % and a pH ranging from 3 to 5. The wood fibers may be produced by using concomitantly wood and scrap wood from scrap wood fiber boards. The solids concentration of the slurry is set to range from 2 to 3 wt % since a solids concentration ranging from 2 to 3 wt % favors dispersion of wood fibers in water. If the solids concentration of the slurry exceeds 3 wt %, the wood fibers fail to be dispersed uniformly, while a substantial amount of water is required at a solids concentration lower than 2 wt %. The reason for setting the pH of the slurry to range from 3 to 5 is that wood fibers and paraffin are complemented with good efficiency by an amphoteric polyacrylamide resin containing monomers having cationic groups and monomers having anionic groups at a ratio of 7:3 to 3:7, on a mole ratio basis. Also, flocks can be formed with good efficiency for a pH range of the polymer ranging from 3 to 5.

In the step of producing a mat by adding only paraffin and an acrylamide resin to the obtained slurry and performing sheet forming, there is added an amphoteric polyacrylamide resin containing monomers having cationic groups and monomers having anionic groups at a ratio of 7:3 to 3:7, on a mole ratio basis, the resin having a molecular weight ranging from 800,000 to 3,000,000, and there is added paraffin, which is cationic. The paraffin and the polyacrylamide resin may be added simultaneously. Alternatively, the paraffin may be added first, followed by addition of the polyacrylamide resin. Addition is performed in such a manner that the paraffin ranges from 0.2 to 0.9 wt % with respect to total solids of the wood fibers and the polyacrylamide resin ranges from 0.1 to 0.6 wt % with respect to total solids of the wood fibers. The proportions of paraffin and polyacrylamide resin with respect to the wood fibers are all values on a solids basis. The rationale for these addition amounts are as described above. The obtained slurry is run off on a wire mesh, and the rear face of the wire mesh is vacuum-dewatered, to form a mat. Through such sheet-forming, wood fibers become disposed in such a manner that the longitudinal direction of the fibers is substantially horizontal, on the front face side, while on the rear face side (wire mesh side) the longitudinal direction of the fibers is substantially vertical, on account of vacuum suction. The mesh pattern of the wire mesh is transferred to the rear face of the mat, and hence the rear face of the mat exhibits a rough surface. The obtained mat is further dewatered, if necessary, by cold pressing. After addition of the paraffin and the polyacrylamide resin, the slurry may be stirred while the slurry runs off on the wire mesh.

The obtained mat is heat-pressed. Heat pressing is performed by three-stage pressing that involves pressing at a temperature ranging from 180 to 220° C., and a pressing pressure of 40 kg/cm$^2$ for 30 to 50 seconds, 8 to 10 kg/cm$^2$ for 60 to 180 seconds, and 20 to 35 kg/cm$^2$ for 60 to 90 seconds, in the case of producing a 2.5 mm-thick wood fiber board. In this three-stage pressing, the pressure is lowered in the second stage, and hence the water vapor in the mat can escape readily. Mat puncturing is thus prevented. The press machine used in the three-stage pressing has an upper mold and a lower mold.

Wire mesh or a perforated board is laid, as a spacer, at the surface of the lower mold. Water squeezed out of the mat is drained thereby out of the press machine.

After pressing, the obtained wood fiber board is wetted or humidity-conditioned, to adjust thereby the moisture content to a desired moisture content, and the board is cured for a given lapse of time, to yield thereafter the product.

Examples of the present invention are explained next.

Wood was crushed, and was steamed and fibrillated using a refiner, to yield wood fibers. The wood fibers were dispersed in water, to yield a slurry having a solids concentration of about 2 wt % and a pH ranging from 3 to 5. To the obtained slurry there were added an emulsion of cationic paraffin, and an amphoteric polyacrylamide resin containing monomers having cationic groups and monomers having anionic groups in a mole ratio of 6:4, the resin having a molecular weight ranging from 1,700,000 to 2,000,000. The slurry was stirred for one minute, was thereafter run off on a wire mesh, and the rear face of the wire mesh was vacuum-dewatered, to form a mat. Herein, paraffin was added so as to yield solids of 0.4 wt % with respect to total solids of the wood fibers, and a polyacrylamide resin was added so as to yield solids of 0.1 wt % with respect to total solids of the wood fibers. The obtained mat was subjected to three-stage pressing at a temperature ranging from 180 to 220° C., under 40 g/cm$^2$ for 40 seconds, 8 to 10 kg/cm$^2$ for 60 to 180 seconds and 30 kg/cm$^2$ for 60 to 90 seconds. Humidity conditioning was performed thereafter, to yield a wood fiber board of Example 1.

A wood fiber board of Example 2 was produced in the same way as in Example 1, but herein there was added 0.4 wt % of polyacrylamide resin with respect to total solids of the wood fibers.

A wood fiber board of Example 3 was produced in the same way as in Example 1, but herein there was added 0.6 wt % of polyacrylamide resin with respect to total solids of the wood fibers.

Scrap wood of Scrap wood fiber boards was crushed, and was steamed and fibrillated using a refiner, to yield wood fibers. Wood fibers resulting from steaming and fibrillating of wood, as well as wood fibers resulting from steaming and fibrillating of scrap wood from wood fiber boards, were added to water, in a weight ratio of 9:1. The wood fibers were dispersed in water, to yield a slurry having a solids concentration of about 2 wt % and a pH ranging from 3 to 5. A wood fiber board was produced otherwise in the same way as in Example 1, to yield a wood fiber board of Example 4.

Wood was crushed, and was steamed and fibrillated using a refiner, to yield wood fibers. The wood fibers were dispersed in water, to yield a slurry having a solids concentration of about 2 wt % and a pH ranging from 3 to 5. The slurry was run off on a wire mesh, and the rear face of the wire mesh was vacuum-dewatered, to form a mat. Herein, the slurry had no polyacrylamide resin, paraffin, or phenolic resin added thereto. A wood fiber board was produced otherwise in the same way as in Example 1, to yield a wood fiber board of Comparative example 1.

Wood was crushed, and was steamed and fibrillated using a refiner, to yield wood fibers. The wood fibers were dispersed in water, to yield a slurry having a solids concentration of about 2 wt % and a pH ranging from 3 to 5. An emulsion of cationic paraffin and a phenolic resin were added to the obtained slurry. A wood fiber board was produced otherwise in the same way as in Example 1, to yield a wood fiber board of Comparative example 2. Herein, paraffin was added so as to yield solids of 0.4 wt % with respect to total solids of the wood fibers, and the phenolic resin was added so as to yield solids of 0.5 wt % with respect to total solids of the wood fibers.

A wood fiber board of Comparative example 3 was produced in the same way as in Example 1, but herein there was added 0.8 wt % of polyacrylamide resin with respect to total solids of the wood fibers.

The wood fiber boards obtained in Examples 1 to 4 and Comparative examples 1 to 3 were measured for thickness, dry density, moisture content, flexural strength and water absorption rate. The results a given in Table 1. The thickness, dry density, moisture content, flexural strength and water absorption rate were measured according to JIS A 5905-2003.

TABLE 1

| | | Example 1 | Example 2 | Example 3 | Example 4 | Comp. ex. 1 | Comp. ex. 2 | Comp. ex. 3 |
|---|---|---|---|---|---|---|---|---|
| Thickness | mm | 2.33 | 2.32 | 2.29 | 2.32 | 2.26 | 2.35 | 2.36 |
| Dry density | | 0.91 | 0.96 | 0.93 | 0.89 | 0.90 | 0.88 | 0.92 |
| Moisture content | % | 9.0 | 5.6 | 6.6 | 8.5 | 6.8 | 7.6 | 6.8 |
| Flexural strength | N/mm$^2$ | 22.9 | 26.5 | 27.8 | 22.8 | 21.1 | 23.0 | 21.4 |
| Water absorption rate | % | 28.0 | 28.2 | 32.5 | 27.5 | 74.1 | 39.4 | 34.6 |

The flexural strength and water absorption rate in the wood fiber boards of Examples 1 to 4 were superior to those of the wood fiber board of Comparative example 1, which comprised wood fibers alone, and were comparable to those of the wood fiber board of Comparative example 2, which was produced through addition of a phenolic resin. The wood fiber board of Comparative example 3, in which 0.8 wt % of a polyacrylamide resin was added, with respect to total solids of the wood fibers, exhibited poorer flexural strength than the wood fiber board of Comparative example 2.

Embodiments of the present invention have been explained above, but the present invention is not limited thereto, and can be embodied in various ways without departing from the scope of the invention as defined in the appended claims As explained above, the present invention succeeds in providing a wood fiber board, and a production method thereof, such that the wood fiber board contains no phenolic resin, is simple to produce, and boasts flexural strength and water resistance comparable to those of wood fiber boards produced by incorporating a phenolic resin.

What is claimed is:

1. A wood fiber board consisting of:

wood fibers;

a polyacrylamide resin; and paraffin, wherein the polyacrylamide resin is an amphoteric-ionic resin, contains monomers having cationic groups and monomers having anionic groups at a ratio of 7:3 to 3:7, on a mole ratio basis, the paraffin is cationic, an amount of the polyacrylamide resin is from 0.1 to 0.6 wt % with respect to total solids of the wood fibers, an amount of the paraffin is from 0.2 to 0.9 wt % with respect to total solids of the wood fibers, and the wood fibers are tangled with one another, and the polyacrylamide resin and the paraffin fill gaps between the wood fibers.

2. The wood fiber board according to claim 1, wherein the wood fibers are fibers obtained through the steaming and fibrillating of wood and scrap wood from scrap wood fiber boards, and the content of fibers obtained through steaming and fibrillating of scrap wood from scrap wood fiber boards is less than 10 wt % with respect to total solids of the wood fiber board.

3. A method of producing a wood fiber board, the method comprising the steps of:

producing a slurry by dispersing wood fibers in water;

producing a mat by adding only cationic paraffin and an acrylamide resin to the obtained slurry and performing sheet forming; and heat-pressing the obtained mat, and wetting or humidity-conditioning the mat, followed by curing, so that a wood fiber board consisting of the wood fiber, the cationic paraffin and the acrylamide resin, is obtained, wherein in the step of producing a slurry, the slurry is prepared so that the slurry has a solids concentration of 2 to 3 wt % and pH of 3 to 5, and in the step of producing a mat, an amphoteric polyacrylamide resin being an amphoteric-ionic resin, which contains monomers having cationic groups and monomers having anionic groups at a ratio of 7:3 to 3:7 on a mole ratio basis, is added in an amount of 0.1 to 0.6 wt % with respect to total solids of the wood fibers, and the cationic paraffin is added in an amount of 0.2 to 0.9 wt % with respect to total solids of the wood fibers.

4. The method of producing a wood fiber board according to claim 3, wherein the wood fibers are fibers obtained through steaming and fibrillating of wood and scrap wood from scrap wood fiber boards, and the content of fibers obtained through steaming and fibrillating of scrap wood from scrap wood fiber boards is less than 10 wt % with respect to total solids of the wood fiber board.

* * * * *